US008789346B2

(12) United States Patent
Helbling

(10) Patent No.: US 8,789,346 B2
(45) Date of Patent: Jul. 29, 2014

(54) EXOTIC AIR FOR COMMEMORATING EVENT

(76) Inventor: Edward Helbling, Northport, NY (US)

( * ) Notice: Subject to any disclaimer, the term of this patent is extended or adjusted under 35 U.S.C. 154(b) by 396 days.

(21) Appl. No.: 13/024,869

(22) Filed: Feb. 10, 2011

(65) Prior Publication Data

US 2011/0127173 A1 Jun. 2, 2011

Related U.S. Application Data

(63) Continuation-in-part of application No. 12/558,633, filed on Sep. 14, 2009, now abandoned.

(51) Int. Cl.
*B65B 61/02* (2006.01)
*F17C 13/00* (2006.01)

(52) U.S. Cl.
CPC ..... *B65B 61/02* (2013.01); *F17C 13/00* (2013.01)
USPC ..... 53/467; 53/411; 206/6

(58) Field of Classification Search
USPC ..... 53/408, 432, 510
See application file for complete search history.

(56) References Cited

U.S. PATENT DOCUMENTS

| | | | | |
|---|---|---|---|---|
| 7,703,261 | B2 * | 4/2010 | Bedashyov | 53/403 |
| 8,052,933 | B2 * | 11/2011 | Schirmer et al. | 422/507 |
| 2006/0051245 | A1 * | 3/2006 | Schirmer et al. | 422/99 |
| 2009/0036226 | A1 * | 2/2009 | Bedashyov | 472/137 |
| 2009/0196025 | A1 * | 8/2009 | Joseph et al. | 362/154 |
| 2012/0168024 | A1 * | 7/2012 | Beck et al. | 141/1 |

* cited by examiner

*Primary Examiner* — Hemant M Desai
(74) *Attorney, Agent, or Firm* — Andrew Wilford

(57) ABSTRACT

Air is trapped in a container at an origin location associated with an event, and the container is sealed to hermetically confine the trapped air therein. The container is provided with a commemorative object or indicia identifying the event associated with the air that was trapped, typically by fixing the object on the container or on a support carrying the container. The container with the commemorative object are then moved to a destination location distant from the location at which the event took place, and the container holding the air and provided with the commemorative object is displayed there.

7 Claims, 1 Drawing Sheet

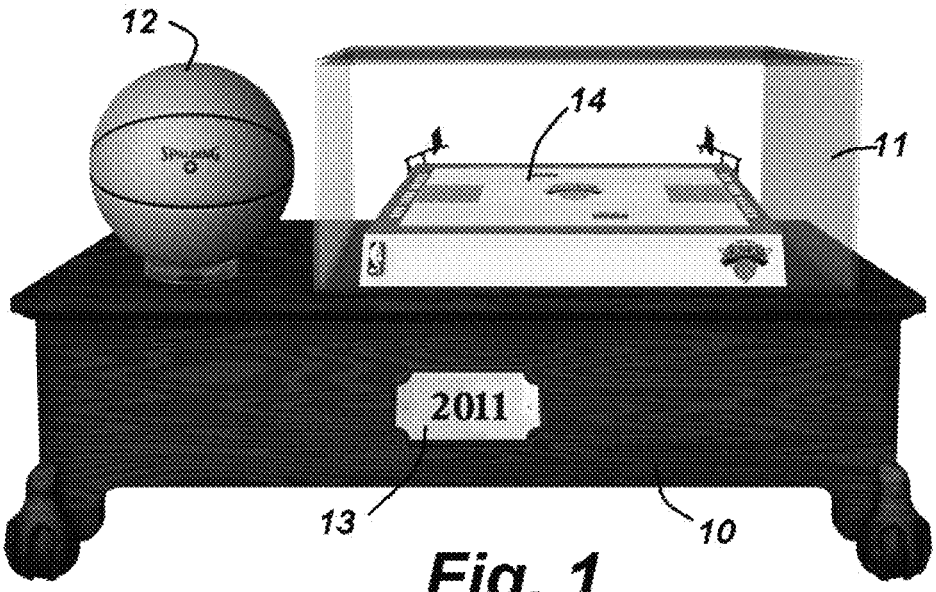
Fig. 1
Fig. 2
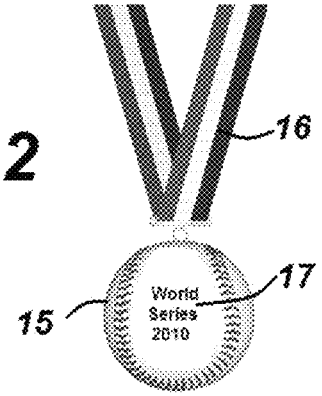
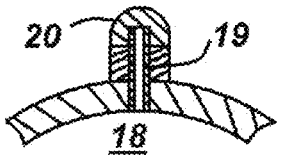
Fig. 3

EXOTIC AIR FOR COMMEMORATING EVENT

CROSS REFERENCE TO RELATED APPLICATION

This application is a continuation-in-part of application Ser. No. 12/558,633 filed 14 Sep. 2009, now abandoned.

FIELD OF THE INVENTION

The present invention relates to an exotic-air system.

BACKGROUND OF THE INVENTION

It is generally believed that certain locations have a therapeutic effect because of some indigenous characteristic. Some say that the air from a particular place has special value, for instance because of its purity, dryness, or a special odor associated with the place.

Whereas such therapeutic value might be based only on a perception rooted in nostalgia, it is hard to say that a perception alone has no therapeutic value. For instance, millions of gallons of bottled water are sold annually to persons believing that water from somewhere else is better than water from the tap, regardless of any scientific proof to the contrary.

Furthermore there is an interest in being able to experience remote locations without having to go there. It is possible to see and hear the sites from, for example, the top of Mt. Everest, but beyond that there are no opportunities for further experiences, for instance scent.

Thus in the above-identified parent application a system is described whereby air is trapped at an origin location in a container, and the container is sealed to hermetically confine the trapped air therein. The container is then provided with literature identifying the origin location at which the air was trapped and giving other information regarding this origin location. Then the container is shipped with the literature to a destination location remote from the origin location. Finally the container is opened and the trapped air is consumed, for instance by being breathed by the user.

Such a system has distinct benefits, but is limited to the coupling with a particular place.

OBJECTS OF THE INVENTION

It is therefore an object of the present invention to provide an improved exotic air system.

Another object is the provision of such an improved exotic air system that extends the advantages of the above-given location-bound system.

A further object is to provide a particular keepsake commemorating a unique or one-time event.

SUMMARY OF THE INVENTION

Air is trapped in a container at an origin location associated with an event, and the container is sealed to hermetically confine the trapped air therein. The container is provided with a commemorative object or indicia identifying the event associated with the air that was trapped, typically by fixing the object on the container or on a support carrying the container. The container with the commemorative object are then moved to a destination location distant from the location at which the event took place, and the container holding the air and provided with the commemorative object is displayed there.

Thus a person who attends a wedding, a championship sporting event, a treaty signing, a birth of a child, or some other event significant to that person will have on display something that actually is physically associated with that event, namely the air trapped in the object.

The air according to the invention is trapped under superatmospheric pressure. In addition the container and the commemorative object are packaged together prior to shipping.

Alternately, the container is provided to the user at or before the event with an interior of the container evacuated to a subatmospheric pressure. A vent on the container is opened at the event to aspirate ambient air from the event into the container. In this case, for example, the container is a miniature ball, hockey puck, or the like associated with the event, for instance a world-series or other championship game.

Furthermore, after sealing the container and before shipping the container, a seal is applied to the container that indicates tampering or impairing of the hermetic seal of the container.

BRIEF DESCRIPTION OF THE DRAWING

The above and other objects, features, and advantages will become more readily apparent from the following description, reference being made to the accompanying drawing in which:

FIG. 1 is a perspective view of a system according to this invention;

FIG. 2 is a front view of another keepsake according to the invention; and

FIG. 3 is a large-scale sectional view of a detail of FIG. 2.

SPECIFIC DESCRIPTION

As seen in FIG. 1 a keepsake according to the invention is intended to celebrate, for instance a 2011 victory in Madison Square Garden by the New York Knickerbockers.

The keepsake comprises a wooden support or base 10 forming a container with a clear-plastic cover 11. Fixed adjacent the cover 11 on the base 10 is a small basketball to provide a clear indication of what is being commemorated. Inside the cover 11 that holds air collected at the Knicks game in question is a miniature basketball court 14.

This keepsake is made as described in the parent application by fitting the cover over the miniature 14 at the site where the event, here a particular basketball game being commemorated, took place. Once the air is trapped under the cover 11, it is sealed to the base 10 and any seam is made hermetic.

FIG. 2 shows another keepsake according to the invention, in this case an item, here a miniature baseball 15, hung from a lanyard 16 and carrying indicia 17 indicating the provenance of the air inside the baseball 15. Instead of a baseball 15, this could be, for instance, a medallion bearing a state seal, the Olympic logo, the presidential seal, or another sporting item such as a miniature soccer ball or hockey puck.

The embodiment of FIG. 2 is a self-serve item and is provided to the user, either at the event being memorialized or beforehand, with its interior 18 (FIG. 3) largely evacuated, that is under substantial subatmospheric pressure. A small nipple 19 on the baseball 15 is covered by a cap 20 that the user can remove at the event so that the ambient air there is sucked into the baseball 15 by the pressure differential, whereupon replacing the cap 20 captures this air inside the ball 15.

It would also of course be possible for the keepsakes according to the invention to be filled at the event by the person selling them. In this case all the seller would need would be a small compressor that would take in the ambient air and force it under pressure into the keepsake so that it flushes out any air therein and replaces it with air from the event.

Thus the owner of the keepsake has in fact something that actually was at the event, the very air that the players and fans breathed and in which the game was played.

I claim:

1. A method comprising the steps of sequentially:

providing a container with a closable vent;

evacuating an interior of the container to a subatmospheric pressure;

maintaining the interior under the subatmospheric pressure prior to an event by closure of the vent;

trapping in a container air at the event by opening the vent at the event to aspirate air at the event through the opened vent into the container;

sealing the container at the event by closing the vent and thereby hermetically confining the trapped air therein;

providing the container with a commemorative object or indicia identifying the predetermined event where the air was trapped;

moving the container with the commemorative object or indicia to a destination location distant from the location at which the event took place; and displaying the container holding air and provided with the commemorative object or indicia.

2. The method defined in claim 1, further comprising the step after sealing the container and before moving the container of:

applying to the container a seal that indicates tampering or impairing of the hermetic seal of the container.

3. The method defined in claim 1 wherein the container is a miniature version of a piece of sporting equipment.

4. The method defined in claim 3 wherein the sporting equipment is a ball.

5. The method defined in claim 1, further comprising the step of providing the container with a lanyard for wearing of the container about a neck of a user.

6. A method comprising the steps of sequentially:

providing a container with a closable vent and with indicia relating to a predetermined event;

evacuating an interior of the container to a subatmospheric pressure;

maintaining the interior under the subatmospheric pressure prior to the predetermined event by closure of the vent;

at the predetermined event, giving the container whose interior is under the subatmospheric pressure to a user;

the user opening the vent at the predetermined event and thereby aspirating into the container air from the predetermined event and then closing the vent to trap the aspirated air in the container so as to hermetically confine the aspirated air in the container;

the user moving the container to a destination location distant from the location at which the predetermined event took place and there displaying the container holding the aspirated air and provided with the indicia.

7. The method defined in claim 6, wherein the predetermined event is a sporting event and the container is shaped like an element of a game played at the event.

* * * * *